United States Patent [19]

Deuker et al.

[11] 4,195,575

[45] Apr. 1, 1980

[54] MECHANICAL TIME DELAY SAFETY AND ARMING MECHANISM

[75] Inventors: Daniel A. Deuker, Mesa; Paul A. Hartwell, Chandler, both of Ariz.

[73] Assignee: Motorola, Inc., Schaumburg, Ill.

[21] Appl. No.: 17,627

[22] Filed: Mar. 5, 1979

Related U.S. Application Data

[63] Continuation-in-part of Ser. No. 838,522, Oct. 3, 1977, abandoned.

[51] Int. Cl.[2] ..... F42C 9/06; F42C 15/22

[52] U.S. Cl. ..... 102/232; 102/235; 102/277

[58] Field of Search ..... 102/232, 233, 231, 238, 102/237, 235, 277, 244

[56] References Cited

U.S. PATENT DOCUMENTS

| | | | |
|---|---|---|---|
| 2,490,389 | 12/1949 | Wales | 102/235 |
| 2,834,292 | 5/1958 | Viasmensky | 102/238 X |
| 2,978,984 | 4/1961 | Czajkowski | 102/232 |
| 3,073,241 | 1/1963 | Rosselet | 102/238 |
| 3,603,259 | 9/1971 | Webb | 102/235 |
| 3,962,973 | 6/1976 | Duel | 102/233 |
| 4,015,532 | 4/1977 | Morrow | 102/238 X |

*Primary Examiner*—David H. Brown
*Attorney, Agent, or Firm*—Eugene A. Parsons

[57] ABSTRACT

A base member mounted on a projectile with a movable member mounted thereon for radially outwardly sliding movement in response to spinning of the projectile, the movable member having a center of gravity located at a first point which prevents the sliding movement thereof and the center of gravity being shiftable to a second point by the controlled flow of a predetermined mass, e.g. steel balls, which shifting of the center of gravity allows the movable member to slide from the safe to the arm position.

8 Claims, 2 Drawing Figures

MECHANICAL TIME DELAY SAFETY AND ARMING MECHANISM

RELATED APPLICATION

This application is a continuation-in-part of the copending patent application, Ser. No. 838,522, filed Oct. 3, 1977, now abandoned and bearing the same title.

BACKGROUND OF THE INVENTION

Safeing and arming mechanisms for spinning explosive projectiles and the like generally require some mechanism or electronic circuitry for timing to arm the fuze a predetermined time after the projectile is launched. It is essential that the fuze be maintained in the safe position or mode until the projective is safely away from the gun or other launching device. To provide this feature some form of timer is incorporated in the fuze and is initiated when setback and/or spin of the fuze begins. In many prior art safeing and arming mechanisms the timing apparatus is extremely complicated and/or costly and because of a large number of moving parts or electrical components the reliability is seriously reduced.

SUMMARY OF THE INVENTION

The present invention pertains to a mechanical time delay safety and arming mechanism for fuzes on spinning explosive projectiles and the like wherein a sliding member is slideably mounted on a base member for generally radial outward movements from a safe position to an arm position in response to the spinning of the projectile and apparatus positioned on the sliding member maintains the center of gravity of the sliding member at a first location for a predetermined period of time subsequent to the start of the spinning of the projectile and, through the controlled shifting of a mass, shifts the center of gravity of the sliding member to a second location which allows sliding movement of the sliding member from the safe position to the arm position.

It is an object of the present invention to provide a new and improved mechanical time delay safety and arming mechanism for fuzes on spinning explosive projectiles and the like.

It is a further object of the present invention to provide a mechanical time delay safety and arming mechanism for fuzes on spinning explosive projectiles and the like which is extremely simple to manufacture and highly reliable in operation.

These and other objects of this invention will become apparent to those skilled in the art upon consideration of accompanying specification, claims and drawings.

BRIEF DESCRIPTION OF THE DRAWINGS

Referring to the drawings, wherein like characters indicate like parts throughout the figures.

DESCRIPTION OF THE PREFERRED EMBODIMENT

Figure 1:
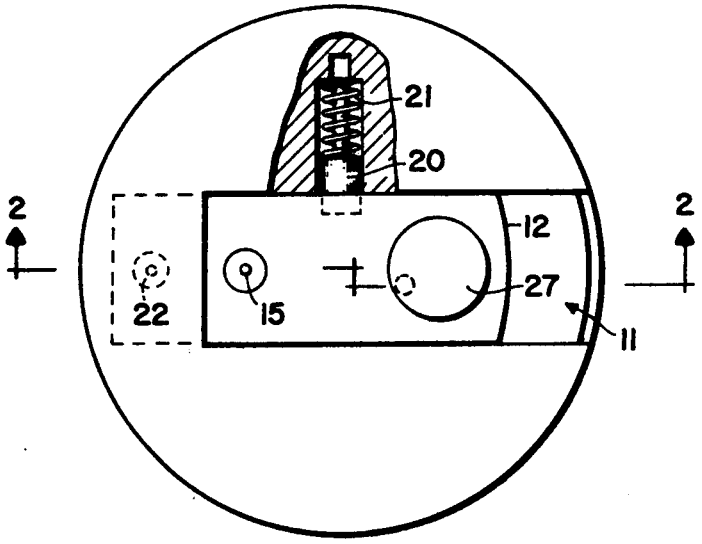
FIG. 1 is a view in top plan of a mechanical time delay safety and arming mechanism embodying the present invention.
Figure 2:
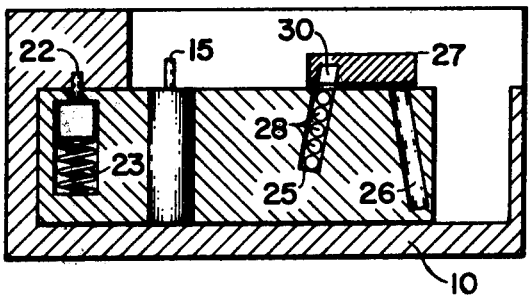
FIG. 2 is a sectional view as seen from the line 2—2 in FIG. 1.

Referring to the Figures, the number 10 designates a generally cylindrically shaped base member having a circular cross-section with the axis of the cylinder designed to be coaxial with the axis of the projectile on which the fuze is mounted. A slot or channel 11 is formed in the base member 10 and extends generally along a partial diameter thereof so that a wall is formed at each end of the channel 11 by the base member 10. A sliding member 12 is mounted for radial movement within the channel 11 and the walls at either end of the channel 11 limit the movement of the sliding member 12. The sliding member 12 is illustrated in the safe position in the Figures and upon sliding to the right (in the Figures) it moves to the arm position. A detonator 15 is mounted at the left end of the sliding member 12 and will be positioned generally along the axis of the base member 10 when the sliding member 12 moves into the arm position.

A spin detent 20 is mounted on the base member 10 and engages the sliding member 12 to prevent movement thereof when the base member 10 and projectile on which it is mounted are not spinning. The spin detent 20 is mounted for generally radial movements outward to disengage the sliding member 12 upon proper spinning of the projectile. A spring 21 engages the spin detent and biases it into engagement with the sliding member 12 when the projectile and base member 10 are not spinning. A setback pin 22 is mounted in the sliding member 12 and biased into engagement with the base member 10 by a spring 23. Upon setback of the projectile the pin 22 is disengaged from the base member 10 to allow free sliding movement of the sliding member 12. As is obvious to one skilled in the art, once the pin 22 is depressed into the cavity in the sliding member 12 by setback forces, the spin forces will move the relatively thin pin laterally out of alignment with the opening and it will remain disengaged from the base number 10 to allow the free sliding movement of member 12 which is mentioned above. While the simplified setback pin 22 is illustrated and described herein, because the pin forms no part of the invention and is not required for the proper operation thereof, it will be understood by those skilled in the art that many other and more complicated setback pins (i.e., the pin described in U.S. Pat. No. 3,793,956, entitled "Switching Arrangement for Electrical Fuzes", issued Feb. 26, 1974 which operates substantially as the disclosed pin 22) might be utilized. Thus, the spin detent 20 and setback pin 22 prevent movement of the sliding member 12 prior to setback and spin of the projectile and are disengaged upon setback and spin to allow free movement of the sliding member 12 in the channel 11.

The sliding member 12 has apparatus thereon for shifting the center of gravity thereof within a predetermined period of time after the commencement of spinning of the projectile. This center of gravity shifting apparatus includes a first cavity 25, a second cavity 26, a rotor 27 and a plurality of balls 28, which in this embodiment are made of a metal such as steel or the like. The first cavity 25 is formed in the sliding member 12 so as to extend from the upper surface thereof slightly radially inwardly so that when the balls 28 are positioned therein they will tend to be thrown from the cavity 25 by spinning of the projectile. The second cavity 26 extends into the sliding member 12 from the upper surface thereof and slants in the opposite direction from the cavity 25 so that balls 28 placed therein will be forced into the cavity 26. The two cavities 25 and 26 are positioned in spaced apart relationship with the rotor 27 rotatably mounted over the external openings thereof. The rotor 27 has at least one ball receiving opening 30 therein and is balanced so that it will rotate or pivot, under centrifugal force until a ball exits the cavity 25 and enters the ball receiving opening 30 in the rotor 27. At this time, the centrifugal force rotates, or pivots, the rotor 27 until the ball in the opening 30 is deposited into the cavity 26 at which time the rotor 27 again returns to the original position to receive a second ball from the cavity 25. In this fashion the rotor 27 continues to transfer the balls 28 from the cavity 25 to the cavity 26.

With all of the balls 28 in the cavity 25 the center of gravity of the sliding member 12 is positioned to the left of the axis of the base member 10 so that the spinning of the projectile tends to force, or maintain, the sliding member 12 to the left in the drawings (in the safe position). When balls 38 are shifted from the cavity 25 to the cavity 26 the center of gravity of the sliding member 12 is shifted to the right of the axis of the base member 10 and the sliding member 12 is free to slide to the right in the Figures and into the arm position. While a specific center of gravity shifting apparatus is illustrated in the present embodiment it should be understood that those skilled in the art might devise other apparatus for shifting the center of gravity of the sliding member 12 within a predetermined period of time to allow the sliding member 12 to move from the safe to the arm position.

Thus, an improved mechanical time delay safety and arming mechanism for fuzes on spinning explosive projectiles and the like is disclosed, which mechanism has few moving parts and is extremely simple to manufacture so that low cost and high reliability are inherent. Also, the mechanism is safe, shock insensitive and cannot be armed during assembly or transportation thereof. While we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

What is claimed is:

1. A mechanical time delay safety and arming mechanism for fuzes on spinning explosive projectiles and the like comprising:

(a) a base member adapted to be affixed to the projectile;

(b) a sliding member slideably mounted on said base member for generally radial outward movement from a safe position to an arm position in response to the spinning of the projectile;

(c) detonator means mounted so as to be properly positioned for detonation of the projectile only when said sliding member is in the arm position; and (d) center of gravity shifting means positioned on said sliding member for maintaining the center of gravity of said sliding member at a first location for a predetermined period of time subsequent to the start of spinning of the projectile to prevent sliding movement of said sliding member in response to spinning of the projectile, said center of gravity shifting means operating in response to spinning of the projectile to shift the center of gravity of said sliding member in the predetermined period of time to a second location to allow sliding movement of said sliding member from the safe position to the arm position.

2. A mechanical time delay safety and arming mechanism for fuzes on spinning explosive projectiles and the like comprising:

(a) a base member adapted to be affixed to the projectile;

(b) a sliding member slideably mounted on said base member for generally radial outward movement from a safe position to an arm position in response to the spinning of the projectile;

(c) detonator means mounted so as to be properly positioned for detonation of the projectile only when said sliding member is in the arm position;

(d) first cavity defined by said sliding member with an external opening directed so that material positioned within said first cavity is forced from said first cavity by spinning of the projectile;

(e) a second cavity defined by said sliding member with an external opening directed so that material positioned in the opening is forced into said second cavity by spinning of the projectile;

(f) weight means positioned in said first cavity and having sufficient mass to cause the center of gravity of said sliding member to be located so as to prevent sliding movement of said sliding member in response to spinning of the projectile; and (g) transferring means responsive to spinning of the projectile for transferring said weight means from said first cavity to said second cavity in a predetermined time, said weight means positioned in said second cavity being sufficient to shift the center of gravity of said sliding member and allow sliding movement thereof in response to spinning of the projectile.

3. A mechanical time delay safety and arming mechanism as claimed in claim 2 wherein the detonator means is mounted on the sliding member.

4. A mechanical time delay safety and arming mechanism as claimed in claim 2 wherein the transferring means includes a rotor mounted over the openings of the first and second cavities, said rotor having an opening therein for receiving at least a portion of the weight means, said rotor being balanced so that the opening therein registers with the opening of said first cavity upon spinning of the projectile and rotates into register with the opening of said second cavity once the portion of the weight means is accepted in the opening of said rotor.

5. A mechanical time delay safety and arming mechanism as claimed in claim 4 wherein the weight means includes a plurality of metal balls and the opening in the rotor is constructed to receive one metal ball at a time.

6. A mechanical time delay safety and arming mechanism as claimed in claim 2 wherein the weight means includes a plurality of metal balls.

7. A mechanical time delay safety and arming mechanism as claimed in claim 6 wherein the first cavity is an elongated, generally radially outwardly slanted, cylindrically shaped cavity.

8. A mechanical time delay safety and arming mechanism as claimed in claim 7 wherein the second cavity is an elongated, generally radially inwardly slanted, cylindrically shaped cavity.

* * * * *